United States Patent [19]

Jay et al.

[11] Patent Number: 5,062,677

[45] Date of Patent: Nov. 5, 1991

[54] WHEELCHAIR BACK SYSTEM

[75] Inventors: Eric C. Jay, Boulder; Michael H. Nordquist, Louisville, both of Colo.

[73] Assignee: Jay Medical, Ltd., Boulder, Colo.

[21] Appl. No.: 607,552

[22] Filed: Nov. 1, 1990

Related U.S. Application Data

[63] Continuation of Ser. No. 7,272,137, Nov. 16, 1988, abandoned.

[51] Int. Cl.[5] ..... A47C 7/42

[52] U.S. Cl. ..... 297/444; 297/DIG. 4

[58] Field of Search ..... 297/231, 440, 444, 460, 297/DIG. 2, DIG. 4

[56] References Cited

U.S. PATENT DOCUMENTS 2,461,055 2/1949 Greitzer ..... 297/444

4,177,807 12/1979 Ocel et al. ..... 297/DIG. 4 X 4,898,425 2/1990 Mundy ..... 297/444

4,989,836 2/1991 Hudson et al. ..... 297/391

*Primary Examiner*—Peter R. Brown

*Attorney, Agent, or Firm*—Cook, Egan, McFarron & Manzo, Ltd.

[57] ABSTRACT

A wheelchair back system provides height adjustability of the back, adjustment of the tilt and a lumbar support for a user. The back system is removably-affixed to vertical wheelchair posts by pairs of upper and lower channels at the lateral edges of the back. One of the channels on each side is open to the rear and the other of said channels is open to the front, whereby the channels engage the wheelchair posts. A clip, affixed to the rear side of the wheelchair posts, releasably engages the front opening channels to secure the back in engagement with the wheelchair post.

9 Claims, 7 Drawing Sheets

FIG.11
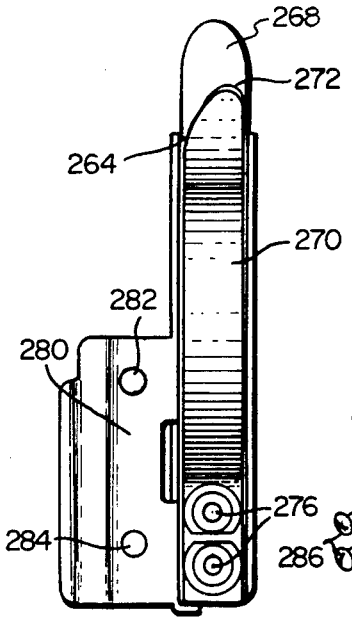
FIG.8
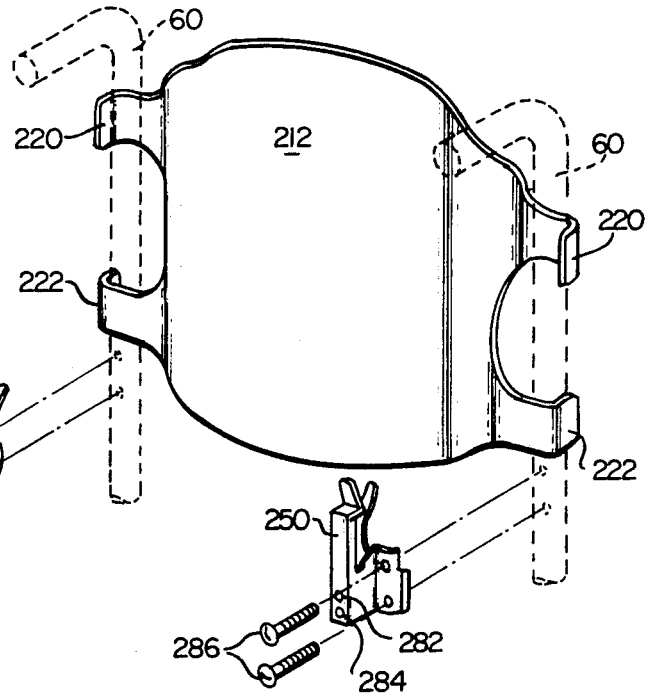
FIG.12
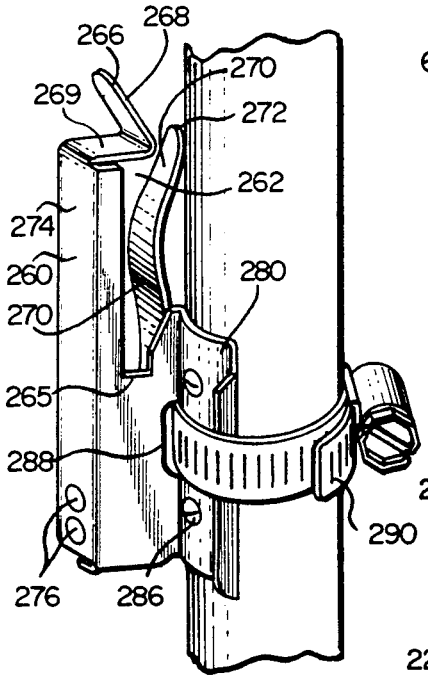
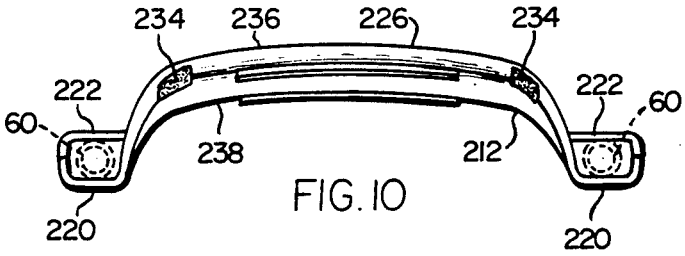
FIG.10
FIG.9
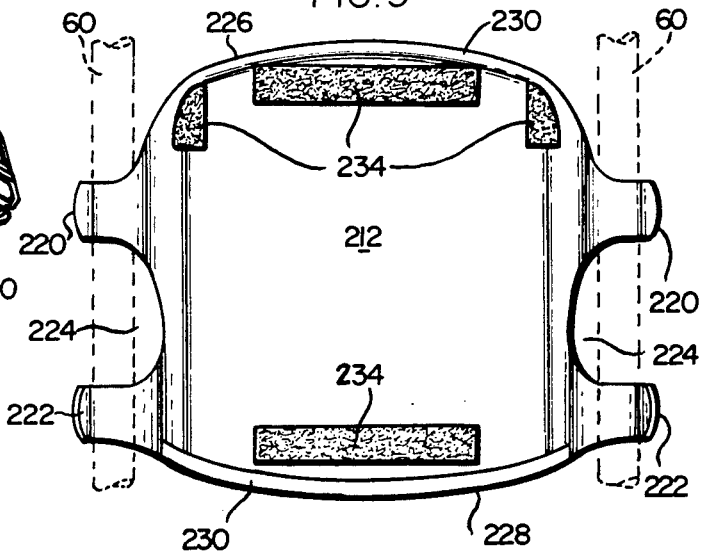

WHEELCHAIR BACK SYSTEM

This application is a continuation-in-part of Ser. No. 272,137 filed Nov. 16, 1988, now abandoned.

The present invention relates to a seat back system for wheelchairs which provides for height adjustability of the back, adjustment of the tilt of the back, a lumbar support which may be positioned to fit the specific height required by the wheelchair user independent of the height of the back, and provides for contoured, adjustable lateral support. The back system may be readily attached to or detached from a wheelchair, in order to fold up the wheelchair for transportation or storage. The wheelchair back system may be used on new wheelchairs and may be retrofitted on existing wheelchairs to replace existing back structures.

BACKGROUND OF THE PRESENT INVENTION

Many of the problems faced by wheelchair users and particularly the paraplegics are kyphosis, scoliosis, instability, redness of the spine, and pain of the back, which conditions are aggravated by soft, curved "sling" upholstery conventionally used in wheelchairs.

The present invention replaced the conventionally used wheelchair back upholstery with a comfortable, sturdy, adjustable, supportive, pressure relieving, easy-to-use back system designed to attack back problems.

Kyphosis

Kyphosis, probably the most common back deformity, is a rounding of the spine in a "humpback" posture and is often combined with a "slouching" posture, with the hips sliding away from the back of the wheelchair. This condition is most common among older patients, but is rapidly becoming a problem among young paraplegics and quadriplegics sitting against low "sport" backs that sag after a few months' use.

The back system of the present invention is firm, to prevent sagging of the back, and it is contoured to conform to the natural curvature of the back and to provide lateral stability. Additionally, a built-in adjustable lumbar support allows the user to sit straighter, thus preventing rounding of the back and resulting kyphosis.

Scoliosis

Scoliosis, an "S" curvature of the spine, is most frequently developed by females. It is often caused by a non-supportive sitting base that encourages pelvic obliquities (uneven hips) and aggravated by a wheelchair back that does not provide support from side to side.

The back system of the present invention supports against side to side leaning and the development of scoliosis in three ways:

1. By restoring the lumbar curve of the user, it mechanically stabilizes the spine of the user to reduce the tendency to lean to one side;

2. By totally conforming to the back of the user, it naturally grips the user's back to provide natural lateral support; and 3. By allowing VELCRO attachment of contoured lateral supports, the user can take advantage of the most comfortable, unobtrusive lateral supports available today.

Instability

The tendency to fall from side to side or to fall forward is common among users with head injuries, multiple sclerosis, quadriplegics and other disabilities where there is an impairment of cognitive or nerve function. To prevent this tendency, these patients tend to slouch in their wheelchairs in order to lower their center of gravity and gain stability. This slouching may result in kyphosis, aggravated back pain, coccygeal pressure sores, and improper leg positions.

The back system of the present invention is scientifically contoured to hug the back of the user, thus enabling the user to sit up straight. The contoured lateral supports provide the user with a stable back which allows the user to sit taller in the wheelchair, with less fear of falling.

Redness of the Spine

The spine is a series of bony protrusions that are subject to pressure, shearing and abrasion—and a resulting skin redness and breakdown. The most prevalent problems come with kyphosis and scoliosis, which can accentuate a bony prominence. Skin breakdown can also result from an extreme weight loss or a gibbus deformity (where the spine is fused after a break).

The back system of the present invention reduces the outward protrusion of the spine, by sitting the user straighter. In addition, a fluid filled pad is inserted up and down the middle of the back, to solve pressure problems where they are most likely to occur—on the spine. Additionally, a $\frac{1}{4}$–$\frac{1}{2}$ inch layer of reticulated open cell foam behind the cover increases comfort and reduces pressure on shoulder blades and other bony protrusions.

Back Pain

Back pain is undoubtedly the most common back complaint. It can be caused by any of the factors mentioned above. The most common cause, however, is a backward tilt of the pelvis, a loss of the natural lumbar curve, and the resulting strain placed on the spine and on connecting muscles. The current invention helps restore the natural lumbar curve to reduce the incidence of back pain.

The back system of the present invention also provides a universal mounting system which will accommodate wheelchairs having differing widths, wherein the vertical posts are spaced at different distances, it will accommodate posts of different diameter, and it will accommodate posts which have a different tilt or curvature. This allows the back system of the present invention to be retrofitted on existing wheelchairs, as well as installed as original equipment on new wheelchairs. Moreover, the mounting system which forms a part of the present invention allows ready removal of the back system in order to collapse the chair for transportation or storage and provides for easy reinstallation to produce a stable wheelchair back. The attachment system is also easy enough to use that a quadriplegic with limited hand function can still install it. A paraplegic can remove or install the back of the present invention from a wheelchair with one hand. This is particularly important in car transfer, when the paraplegic must hold onto his steering wheel with one hand for balance, while folding the wheelchair with his other available hand.

BRIEF DESCRIPTION OF THE PRESENT INVENTION

The present invention provides a wheelchair back system which provides a high degree of support and adjustability in order to accomplish various therapeutically significant functions, while at the same time providing a wheelchair back system which has a streamlined appearance and is generally aesthetically pleasing.

Specifically, the wheelchair back system of the present invention provides a back which may be raised and lowered to accommodate the stabilization needs of the patient; it may be tilted forward or to the rear to accommodate the needs of the wheelchair user; it includes an adjustable height lumbar support; a unique spinal protection device; and adjustable side bolsters to provide back support and stability as may be needed by a wheelchair user. Further, the back support system of the present invention provides for ready adjustment of these features and, at the same time, provides for easy disengagement of the back system when it is desired to fold up the wheelchair for transportation or storage. Still further, the present invention provides a wheelchair back system with a cover which may be readily removed for laundering. The wheelchair back system of the present invention may be retrofitted on existing wheelchairs, as well as fitted as original equipment on wheelchairs. A further embodiment of the present invention provides a back which may be easily and quickly removed from the mounting system and hence the wheelchair, but also provides support for the user. The wheelchair back system of this further embodiment provides a limited amount of "give" or flexing in the back to allow an active user a wider range of motion without causing discomfort and with out accidentally disengaging the back from the wheelchair's vertical posts. The wheelchair back system of the further embodiment of the present invention may be custom fit permanently onto a wheelchair or may be temporarily installed. The back system of the further embodiment also provides a detachable cushion and cover, as above, and may be used on wheelchair of varying widths.

DESCRIPTION OF THE DRAWINGS

In order that the invention may be more readily understood including the various embodiments of the invention, references made to the accompanying drawings in which:

FIG. 8 is an isometric, exploded rear view of an further embodiment of the wheelchair back system showing the attachment of the plastic shelf to the vertical wheelchair posts;

FIG. 9 is a front view of the shell of the further embodiment of the wheelchair back system affixed to the vertical wheelchair posts;

FIG. 10 is a top view of the shell of the further embodiment of the wheelchair back system of this invention;

FIG. 11 is a front view of a post clip of the further embodiment of this invention;

FIG. 12 is an isometric view of the post clip of the further embodiment of this invention mounted on a wheelchair post;

DETAILED DESCRIPTION OF THE PRESENT INVENTION

Figure 3:
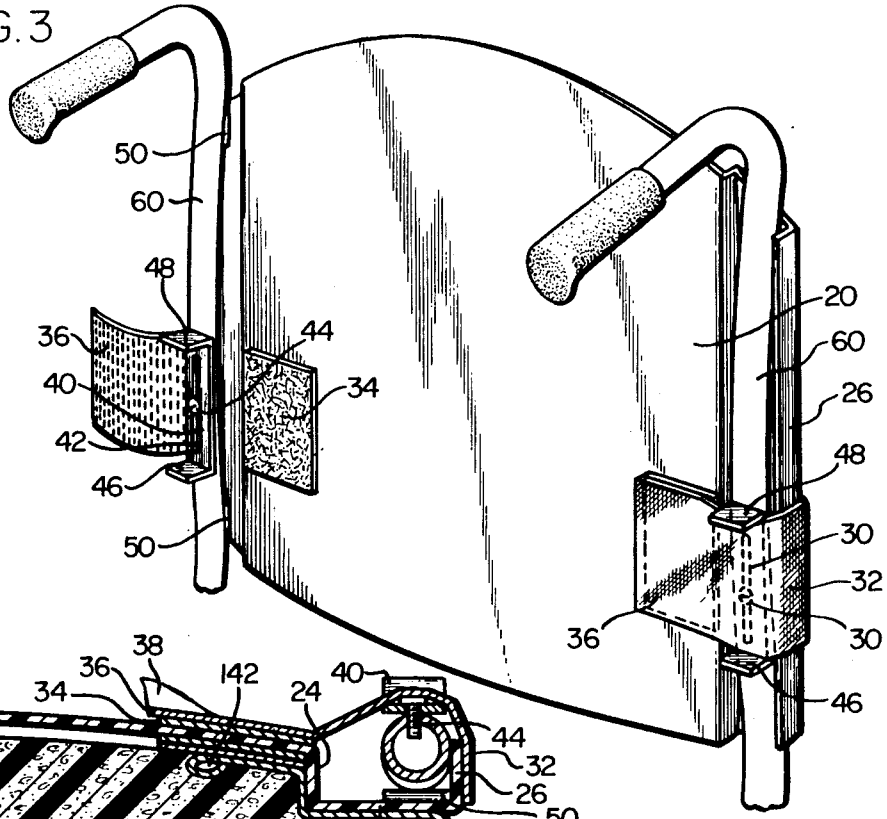
FIG. 3 is an isometric rear view of the wheelchair back system showing the attachment of the hard shell to the vertical wheelchair posts.

The wheelchair back system of the present invention generally comprises a substantially rigid shell 20 and mounting system 30 which is used to affix shell 20 to vertical posts 60 of a wheelchair. Mounting system 30 attaches shell 20 to vertical posts 60 and provides for vertical adjustment of the shell 20 with respect to posts 60.

Cushion 70 is attached to shell 20 and serves to cushion the back of the wheelchair user. Vertical channel 80 in cushion 70 provides space for pad 90 which is filled with a flowable fluid and thus provides for protection of the spine, particularly in the thoracic region, for wheelchair users. Lumbar support 120 is affixed to cushion 70, preferably astride channel 80 and under flowable fluid filled pad 90. Lumbar support 120 is vertically adjusted along channel 80 of cushion 70.

Bolsters 130, which are removably attached to cushion 70, provide additional lateral support to the wheelchair user, if necessary.

Cover 140 is adapted to cover cushion 70 along with bolsters 130 and the lumbar support 120, etc., and extend around the edges of cushion 70, and lock between cushion 70 and shell 20 when cushion 70 is mounted to shell 20. Cover 140 thus provides the wheelchair back system with a streamlined, aesthetically desirable appearance.

Shell

Shell 20 is a hard, relatively rigid, relatively inflexible matrix which extends between the wheelchair posts 60 and provides mechanical support for the back system. It may be produced by formed ABS plastic about 150–250 mils thick. In wheelchair back systems designed for adult use, shell 20 should be about 13 to 24 inches from top to bottom. The overall width of shell 20 should be sufficient to extend from the outside edge of one vertical wheelchair post 60 to the outside edge of the opposite vertical wheelchair post 60. Shell 20 may have a slight convex curvature to generally conform to the backward bend used by most wheelchair posts.

The lateral edges of shell 20 preferably comprise U-shaped channels 22, which extend from the top to the bottom of shell 20. Channels 22 are made up of inner leg 24 and outer leg 26. The space between inner leg 24 and outer leg 26 should be wide enough to wrap around vertical posts 60 of different diameters and having different spacings. Accordingly, it is preferred that channels 22 be about 2 inches wide. Outer leg 26 of channel 22 preferably extends approximately to the rear of vertical posts 60 and provides side to side support for the back system. Outer leg 26 is also aesthetically designed to serve as a cover for vertical posts 60. Outer leg 26 may be shortened if desired for aesthetic purposes, or cut to accommodate tight wheelchair arm rests.

If shell 20 has a slight convex curvature, channel 22 is also convex, but it is preferred that channel 22 have flat portions 28 at its upper and lower end in order to provide for a two point contact of the channel 22 against vertical post 60. Preferably, the flat portion 28 of the channel 22 will cooperate with spacers 50 in adjusting the tilt of the back system, as is described below. Tilt adjustment may be accomplished by inserting or eliminating foam wedges between the shell and the cushion.

It is contemplated that the inner legs 24 of channels 22 will abut the vertical posts 60 in those wheelchairs which are designated 17 inch wheelchairs. Similarly, it is contemplated that the outer legs 26 of channels 22 will abut the outer side of vertical posts 60 in 18 inch wheelchairs. It is contemplated that for wheelchairs having posts with nonstandard spacing, spacers may be employed to securely position vertical posts 60 with respect to legs 24 and 26. It is contemplated that additional sizes will be introduced for 9–10, 11–12, 13–14, 15–16 and 19–20 inch wide wheelchairs. These may be produced in various heights.

The Mounting System

Mounting system 30 is a "soft system" (i.e., it is essentially free of hardware components) and comprises straps 32 affixed to outer legs 26 and adapted to extend to the rear of vertical post 60 and extend along the back of shell 20, over pad 34. Preferably, pad 34 is a rectangle of VELCRO affixed to the back of shell 20, as shown in FIG. 3. Extension 36 of strap 32 is also fitted with a VELCRO surface on its forward side, where it is adapted to gauge or mate with pad 34, thus securing strap 32 around post 60. Preferably, strap 32 is about 4 inches wide. Extension 36 of strap 32 may include handle means 38 which facilitates disengaging extension 36 from pad 34. Strap 32 may be affixed to outer leg 26 by a variety of means such as a twist lock which will be known to those skilled in the art.

Bracket 40 is affixed to vertical post 60 and is vertically adjustable thereon. Preferably, bracket 40 includes a vertical slot 42 through which screw 44 affixes bracket 40 to vertical post 60. Vertical adjustment of bracket 40 may be achieved by loosening the screw 44, and sling the bracket 40 upwardly or downwardly, as the screw 44 slides in slot 42 and tightening the screw when the desired elevation is achieved. Bracket 40 also includes lower shelf 46 and upper shelf 48 which straddle strap extension 36 and lock strap extension 36 in the desired elevation, thus causing the back to remain at the elevation selected through the adjustment of screw 44 in slot 42 of bracket 40. A useful bracket may omit the upper shelf 48.

Figure 5:
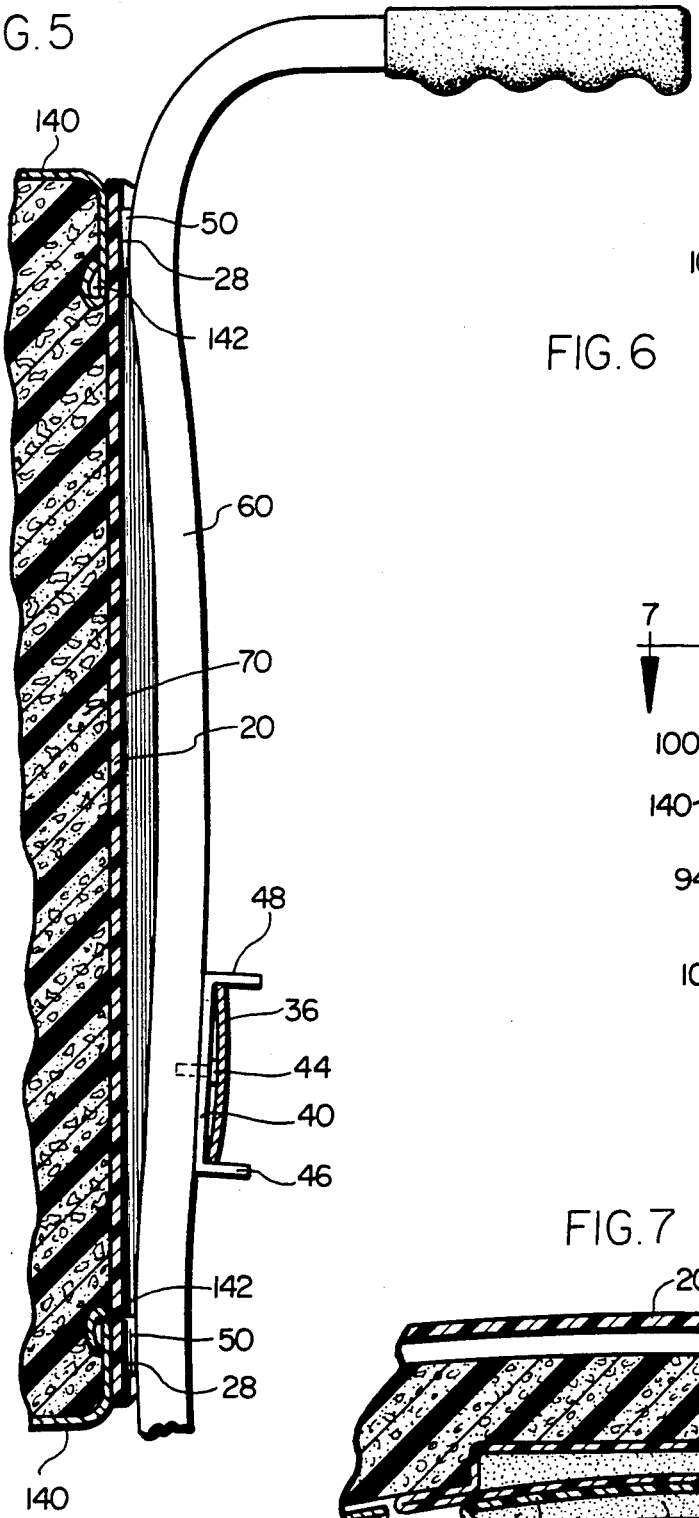
FIG. 5 is a cross-sectional side view of the wheelchair back system, taken at section 5—5 of FIG. 4.

Most wheelchair vertical posts 60 are arcuate in shape, as is shown in FIG. 5. Consequently, shell 20, which may be essentially planar, contacts the vertical posts 60 at the top and the bottom. Thus the tilt (forward and backward) of the seat back system is to some extent a function of the particular curvature of vertical posts 60. The present invention contemplates the use of spacers 50 which are disposed in channels 22, at the top and bottom of channels 22, against flat portions 28, between shell 20 and vertical posts 60. Conveniently, spacers 50 may be adhesively attached to shell 20. In order to obtain tilt adjustment, spacers 50 are either removed or stacked upon one another to create the desired adjustment. Alternatively foam wedges may be inserted between the shell and the cushion to adjust the tilt.

The Cushion

Cushion 70 is preferably fabricated from a self-skinned polyurethane foam, although other materials may be used. Open celled foams may be used where it is desired to reduce the weight of the cushion. Cushion 70 preferably extends into the well defined by shell 20 between channels 22 and extends laterally beyond vertical posts 60. The height of cushion 70 should be approximately the same as the height of shell 20. Thus a cushion of about $18 \times 18 \times 1$ inches is contemplated.

Figure 2:
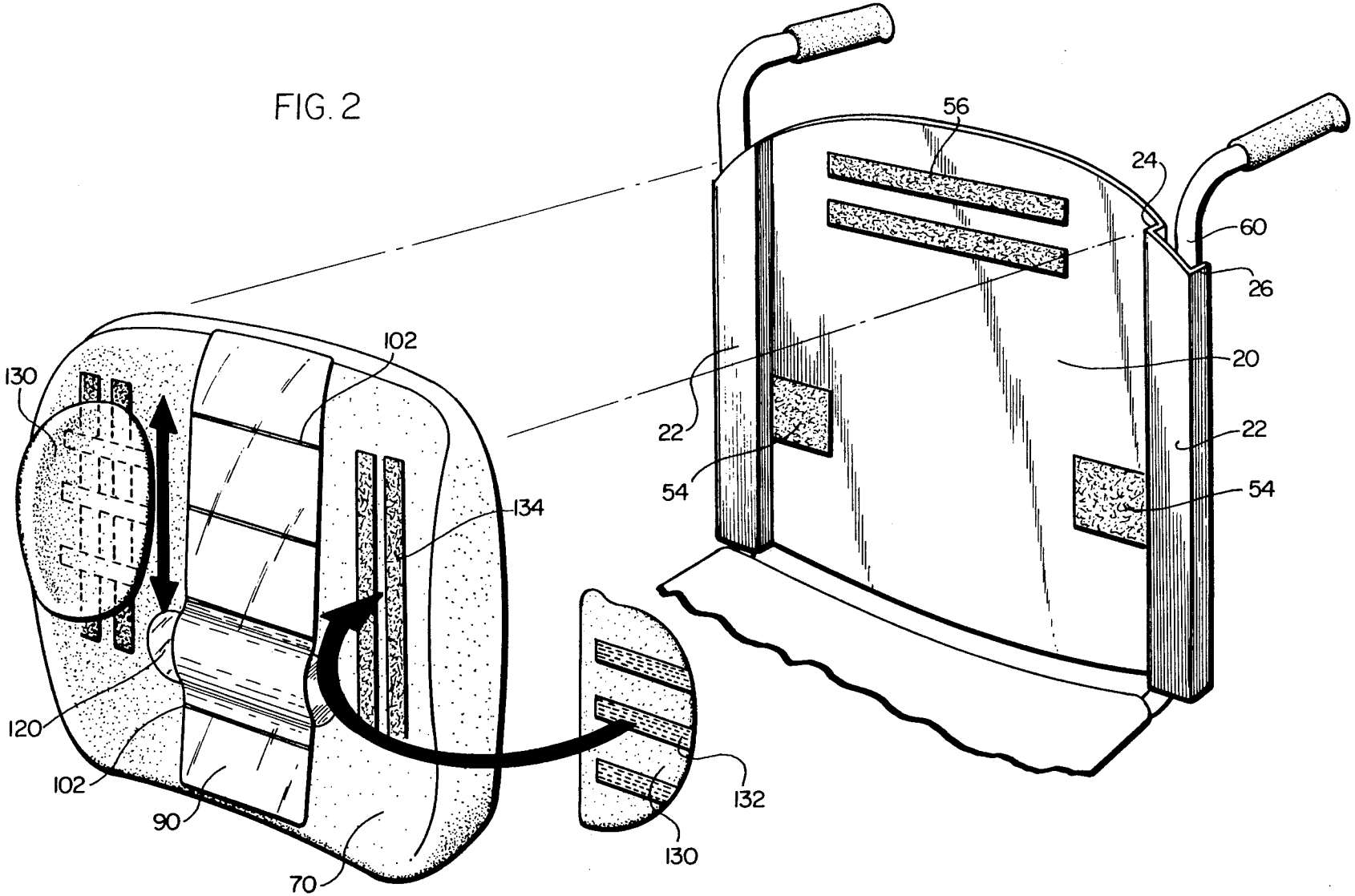
FIG. 2 is an isometric, exploded front view of the wheelchair back system showing the cushion separated from the hard shell positioned on the vertical wheelchair posts.

Cushion 70 is preferably removably affixed to shell 20 by a plurality of VELCRO closures. In the preferred embodiment, as shown by FIG. 2, side VELCRO strips 50 and top VELCRO strips 52 are affixed to shell 20. Corresponding side VELCRO strips 72 and top VELCRO strips 74 are adhesively affixed to the back of cushion 70 and are adapted to engage side VELCRO strips 52 and top VELCRO strips 54 to removably affix cushion 70 to shell 20.

The Channel

Channel 80 is vertically disposed along the center of cushion 70 and extends generally from the top of cushion 70 to the bottom, as shown in FIG. 2. Preferably, channel 80 is about 4 inches wide and about ½ inch deep, although the dimensions are not particularly critical. Similarly, the channel may be shorter, i.e., have a smaller height (measured from top to bottom) than the channel illustrated in FIG. 2.

Pad 90, which is filled with a flowable fluid, is positioned in channel 80 and preferably occupies substantially the entire volume of channel 80. VELCRO strips, not shown, are affixed to pad 90 and corresponding positions in channel 80, in order to secure pad 90 in channel 80.

Figure 6:
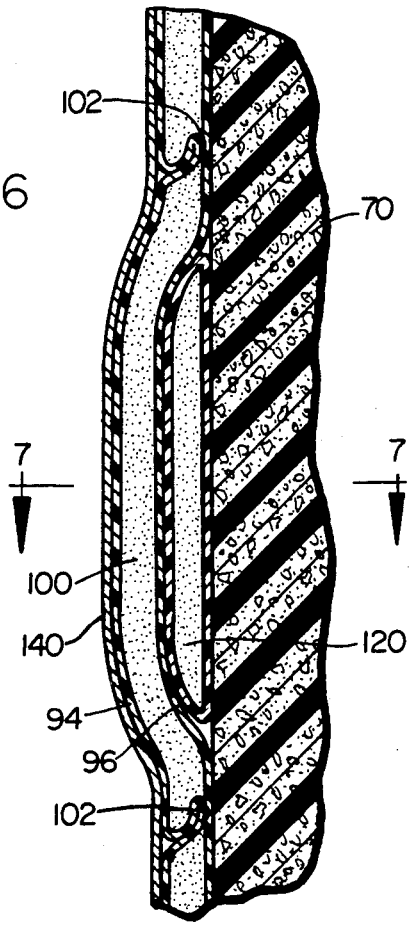
FIG. 6 is a fragmentary cross-sectional side view of the wheelchair back system, taken at section 6—6 of FIG. 1.
Figure 7:
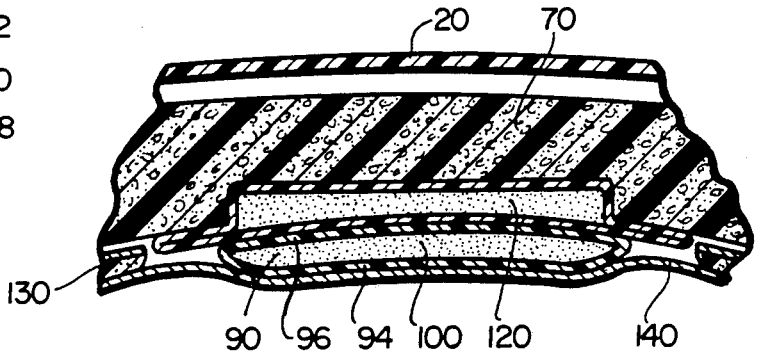
FIG. 7 is a fragmentary cross-sectional top view of the wheelchair system, taken at section 7—7 of FIG. 6.

Pad 90 generally comprises an envelope 92 constructed of a front layer 94 and a back layer 96 of flexible material such as polyethylene or polyurethane. Layers 94 and 96 are heat sealed about the periphery 98, in order to form a container to hold flowable fluid 100. Pad 90 has at least one transverse lateral segment 102 formed by heat sealing front layer 94 to back layer 96 which divides pad 90 into a plurality of horizontally divided chambers. The transverse segment 102 prevents the flowable fluid 100 from flowing downwardly and thus maintains the flowable fluid throughout the entire height of pad 90. Preferably, a tube which is approximately 125% of the length of channel 80 may be filled with a required amount of flowable fluid, flattened and sealed at each end. The tube thus makes up both the front layer 94 and back layer 96 of pad 90. The tube is then heat sealed transversely at appropriate spacings to form transverse segments 102. The transversely sealed tube is then inserted in the channel and the extra 25% of material is draped over the transverse segments 102 as shown in FIG. 6, thus providing for flowable material between the transverse segments and the wheelchair user. Each transverse segment is covered by overlapping the extra material from each chamber over the transverse segment. The overlap is approximately 1 inch. A VELCRO strip is then glued down, and the pad is glued into the overlap position (over the transverse segment). Accordingly, the pad is held in that position resulting in flowable material being between the transverse segment and the wheelchair user.

Alternatively, front layer 94 is puffed out during manufacture, so that the front layer 94 contains more material (more square inches of material) than back layer 96. The use of added material in the front layer 94 allows the front layer 94 to lap over transverse segment 102 as shown in FIG. 6, and thus allow the flowable fluid to come to rest over the transverse segment 102 and provide a cushioning material between the transverse segment 102 and the patient's back.

The Flowable Filling Material

The flowable fluid may be selected from a number of different fluid types. Gases, such as air may be used, but liquids such as water are preferable because the weight of the water provides more stability. However, it is preferred to employ as the fluid a highly viscous liquid, i.e., plastic or viscous thixotropic material, which flows gradually when pressure is applied to it, but which maintains its shape and position in the absence of pressure (hereinafter sometimes referred to as "plastic"). One such viscous fluid is commercially available under the trade name FLO-LITE, the registered trademark of Alden Laboratories. Suitable flowable materials are described and claimed in the U.S. Pat. Nos. listed below, which are incorporated by reference herein:

3,237,319
3,402,411
3,635,849
3,798,799
4,038,762
4,083,127
4,108,928
4,144,658
4,229,546
4,243,754
4,255,202

Additionally, the flowable fitting material described in Applicant's patent application Ser. No. 017,711 filed Feb. 24, 1987, now U.S. Pat. No. 4,78,551, may be used as the flowable material in the practice of the present invention.

Lumbar Support

Lumbar support 120 is designed to fit in channel 80, but may be moved vertically to the position which most comfortably supports the lumber region of the wheelchair user. Lumbar support 120 may be produced from a solid piece of foam material, such as self-skinned polyurethane or polyethylene. Alternatively, the lumbar support may be a pad of the style used for 90, that is, filled with a flowable, viscous, thixotropic material.

Lumbar support 120 is affixed in the channel 80 through VELCRO strips (not shown) attached to the rear side of lumbar support 120 where they engage VELCRO strips which extend vertically up and down the length of channel 80. This allows the lumbar support to be positioned at the correct elevation, independent of the height at which the wheelchair back is set.

Figure 4:
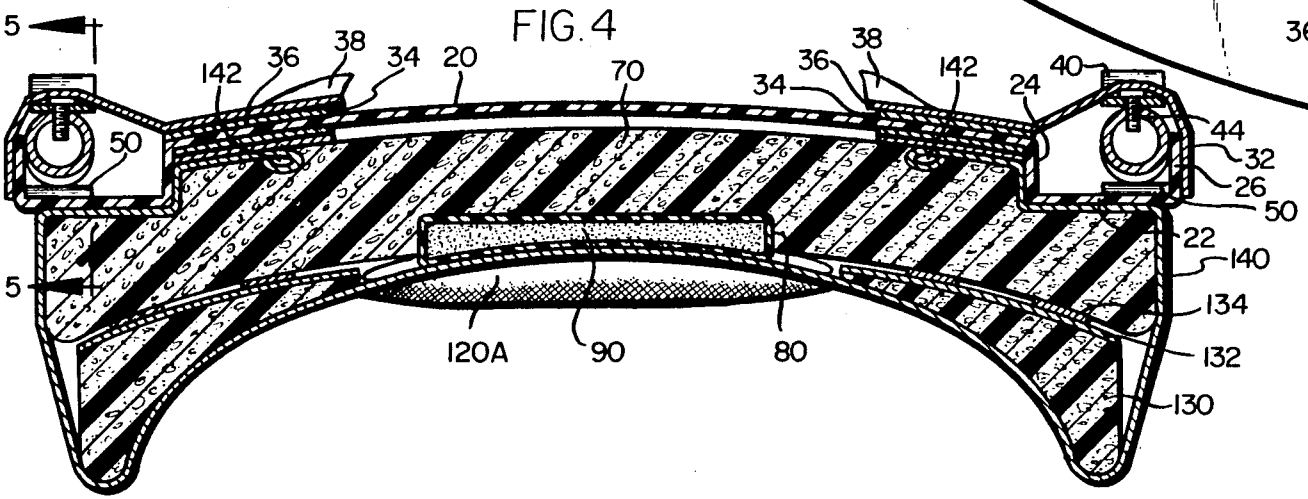
FIG. 4 is a cross-sectional top view of the wheelchair back system, taken at section 4—4 of FIG. 1.

Lumbar support 120 is designed to fit under pad 90 and thus thrust pad 90 forwardly in the region of the lumbar support as shown in FIG. 4—see 120A.

The Bolsters

Bolsters 130 are designed to be removably affixed to the sides of cushion 70 where they provide lateral support for the wheelchair occupant. Preferably, horizontal VELCRO strips 132 are adhered to the rear side of bolsters 130 where they engage vertical VELCRO strips 134 attached to the sides of cushion 70. This allows for vertical and horizontal adjustment of the bolster position with respect to cushion 70. Alternatively, bolsters of the type disclosed in U.S. Pat. No. 3,542,421 may be used.

The Cover

Figure 1:
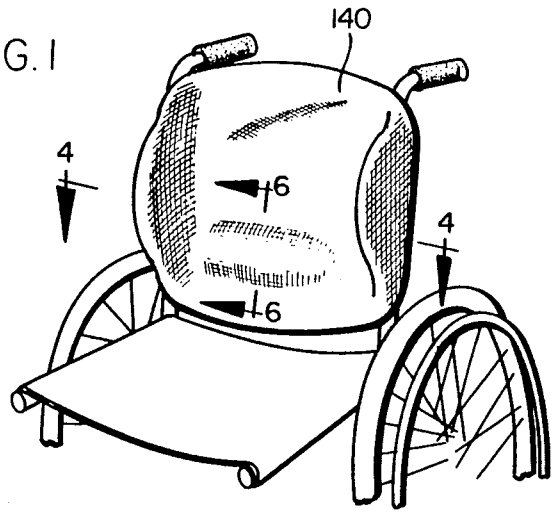
FIG. 1 is an isometric front view of the wheelchair back system, affixed to a wheelchair, with the cover in place thereon.

Cover 140 is designed to fit over cushion 70 and over bolsters 130 to provide the wheelchair back system with a streamlined, aesthetically pleasing appearance, as shown in FIG. 1. As shown by FIG. 4, the cover extends around to the rear of cushion 70. Preferably, elastic means 142 is positioned at the edge of cover 140 in order to urge the cover edges to surround cushion 70. Preferably, elastic means 142 is positioned at the edge of cover 140 in order to urge the cover edges to surround cushion 70. Preferably, elastic means 142 is positioned at the edge of cover 140 in order to urge the cover edges to surround cushion 70. When cushion 70 is affixed to back 20, the edges of the cover 140 are held between cushion 70 and shell 20. Elastic means 142 facilitates the positioning of the cover on cushion 70 before cushion 70 is affixed to the shell 20. Preferably, the cover is lined with a reticulated, open-cell foam, in $\frac{1}{4}$ to $\frac{1}{2}$ inch thickness, to encourage air circulation and provide extra comfort. Preferably, cover 140 has tucks of extra material sewn into the top and/or bottom to allow expansion of the cover when using bolsters 130.

FURTHER EMBODIMENT OF THE PRESENT INVENTION

FIGS. 8 through 14 show a further embodiment of a seat back system according to the present invention. Turning now to FIG. 8, a further embodiment of the wheelchair back system of the present invention is shown generally at 210. The wheelchair back system of the further embodiment of the present invention generally comprises a shell 212 and a mounting system 214. Mounting system 214 is used to affix shell 212 to vertical posts 60 (shown in phantom) of a wheelchair. Mounting system 214 generally comprises a pair of mirror-image post clips 216 mounted on the posts 60 by screws 218, in the preferred embodiment. The mirror-image post clips 216 retain the shell 212 on the vertical posts 60.

Shell

Shell 212 generally comprises a relatively rigid, but somewhat flexible, matrix which extends between the wheelchair posts 60 and provides mechanical support for the back system. Shell 212 may be produced by formed ABS plastic approximately 150–250 mils thick. The shell may be reinforced with metal, fiberglass or other material or may be constructed from aluminum or other metals. In the wheelchair back system 210 designed for adult use, shell 212 is approximately 16¼ inches wide, which is generally sufficient to extend from beyond the outer edge of one vertical wheelchair post 60 to the outer edge of the opposite vertical wheelchair post 60 for a "16 inch" wheelchair. The shell 212 of the this embodiment is approximately 13 inches from top to bottom, and includes a slight convex curvature throughout the shell from top to bottom.

The lateral edges of shell 212 include a pair of U-shaped channels on each side, comprising upper channels 220 and lower channels 222. The present invention contemplates that the upper channel will open in a direction opposite to the opening of the lower channels. The U-shaped channels are designed to circumscribe vertical post 60 on three sides of the back system. In the preferred embodiment, upper channels 220 are open to the rear and circumscribe the post from the front on three sides, and the lower channels 222 are open to the front and circumscribe the post from the rear. The upper and lower channels are separated by an open area 224 on each lateral edge to permit the shell 212 to be inserted between the vertical posts 60 when mounting the shell 212 onto vertical posts 60. The upper channels 220 provide mechanical support for the user to prevent shell 212 from slipping between vertical posts 60. The lower channels 222 are secured in mounting system 214. Mounting system 214 provide shell 212 with vertical and lateral support when the user pushes backwardly against shell 212.

Turning now to FIG. 9, a front view of the alternative embodiment of shell 212 is shown, with vertical posts 60 shown in phantom. In FIG. 9, the opposing nature of upper and lower are channels may be more fully appreciated. Upper channels 220 are disposed in front of vertical post 60, and the lower channels 222 are disposed behind the post. The channels are approximately 1–2 inches in width. While shell 212 described herein is generally described in connection with what is called a "16 inch" wheelchair, the channels are designed so that they will accommodate wheelchairs of somewhat larger and smaller widths. It is envisioned that the dimensions of the shell 212 may be varied to other sized wheelchairs, as appropriate. The width o the channel openings combined with the built in flex of the shell, allow a certain amount of "give" which allows the user a range of motion not before obtainable while still providing back support for the user.

The to edge 226 of the shell 212 is also curved rearwardly. The rearward curve permits the user to arch his/her back over the top of the shell 212 and lean on it so that, for example, the user may pull his/her slacks over the hips. Conventional sling back upholstery stretches in the mid-back top portion when a user performs this maneuver. Stretching shortens the useful life of the sling back. Conversely, a conventional solid back makes no provision for a user to do this. As a result, the solid back digs into the users back uncomfortably, or even painfully.

A bottom edge 228 of shell 212 preferably includes convex arch and a lip 230. Additionally, four strips of VELCRO 234, may be adhesively mounted to the inner side of the shell 212 in this further embodiment. The fasteners permit mounting of a cushion similar to cushion 70, which will be further described below.

Turning now to FIG. 10, a top view of the shell 212 is shown, with vertical posts 60 shown in phantom. FIG. 10 illustrates the convexed outer surface 236 and concave inner or forward surface 238 of this embodiment of seat back system of this invention.

Post clip

Turning now to FIG. 11, a front view of the post clip 250 according to this embodiment of the present invention is shown. Post clip 250 of this embodiment of this invention generally comprises a C-shaped housing 260 and a spring 270. C-shaped housing 260 defines slot 262 which is adapted to engage and retain lower channels 222 of the shell 212. Both the C-shaped housing 260 and the spring 270 of the preferred embodiment comprise steel stampings. The C-shaped housing 260 may be formed in an appropriate jig as is known in the art.

C-shaped housing 260 is joined to a curved mounting bracket 280 designed to mount post clip 250 on the rear side of post 60, preferably on the inward side. Bracket 280 is preferably curved in order to match the rear surface of wheelchair vertical post 60. The pair of mounting brackets 280 for a wheelchair are preferably in mirror image, extending from opposite sides of the C-shaped housing 260. The mounting bracket 280 includes, in this further preferred embodiment, two screw holes 282 and 284 which permit passage of screws 286 to fasten post clip 250 to the vertical posts 60. In this further embodiment an opening 288 adjacent to the C-shaped housing 260 and the mounting bracket 280 permits passage of a hose clamp 290, as described below.

Spring 270 may be mounted in channel 264 of C-shaped housing 260 by mean of two rivets 276 affixed through wall 274 of C-shaped housing 260, in the preferred embodiment. Spring 270 is slightly narrower than channel 264 in this embodiment. Spring 270 includes a shaped top portion 272 which guides lower channels 222 of shell 212 into the slot 262 as will be described below. Top portion 272 also can be used to manipulate spring 270 by the thumb. Spring 270 is biased to urge channels 222 to the rear and to retain channels 222 in slot 262.

FIG. 12 is an isometric view of a post clip 250 mounted on a vertical post 60. In FIG. 12, a hose clamp 290 extends through opening 288 in order to secure the post clip 250 to the vertical post 60. Hose clamp 290 maybe used to temporarily secure post clip 250 to the vertical post 60 when a therapist or other individual is fitting the wheelchair back system of this further embodiment to the user. Hose clamp 290 may then be adjusted as known in the art so that the post clip 250 may be moved up and down, thus raising or lowering the height of the shell relative to the vertical posts 60. Optionally, when the proper height has been determined, the location of the screw holes maybe marked and drilled, as known in the art, screws 286 maybe inserted and tightened and hose clamp 290 may be removed.

Post clip 250 further includes as part of C-shaped bracket 260 lower stop 265 and upper lip 268. In this preferred embodiment, upper lip 267 includes upper stop 269 and a guide surface 268. The guide surface 268 aids in insertion of the lower channel 222 into the slot 262, as will be described below. Upper stop 269 and lower stop 265 retain the lower channels 222 and thus the shell 212 in place on the wheelchair whenever upward pressure is placed on the back.

To mount the seat back system of this embodiment of this invention to a wheelchair, first the sling back or other solid back is removed. Next, hose clamps 290 are inserted into openings 288 of the post clips 250, and the hose clamps 290 are slipped over the vertical posts. A location for post clips 250 is selected and hose clamps 290 are tightened with a screwdriver or other appropriate tool. The post clips 250 are advantageously mounted on the rear side of posts 60 so tat the channels are towards the inside of the vertical posts 60.

Shell 212 is then guided between vertical posts 60 by moving the shell 212 downwardly so that the vertical posts 60 extend between the open area 224 of the shell 212. The shell 212 is then brought upright so that the upper channels 220 contact the vertical posts 60 from the front and the lower channels 222 contact the vertical posts 60 from the rear, just above the post clips 250.

The shell 212 is then lowered and lower channels 222 of the shell 212 between the post clip guide surface 268 and the shaped top 272 of spring 270. The spring 270 biases the rear channels 222 rearwardly into the slot 262 of the C-shaped housing 260 so that the upper edge of lower channel 222 is underneath upper stop 269. Lower stop 265 of slot 262 abuts lower channels 22 to support shell 212 against gravity and other downward loads. If upward pressure is applied to the lower channels 222, as it would be for example when a user were pushing backwards against the lower edge of the shell 212 or, alternatively, when someone lifts the wheelchair by the bottom of the shell, upper edge of lower channels 222 abut upper stop 269, preventing the back from slipping out of the slot 262 of the post clip 250.

When it is desired for the shell 212 to be removed from the wheelchair, the user or an assistant merely pushes forward on the top of the shell 212. This rotates lower channel 222, moves the upper edge of lower channel 222 moves from beneath upper stop 269, and compresses spring 270. The rotation of lower channels 222 push against the bias of the spring, thus permitting the upper edge of the lower channel to clear the lip in stop surface and allows the shell 212 to be lifted from the wheelchair.

FIGS. 15 through 20 illustrate the preferred embodiment of post clip 350 which is mounted on vertical post 60. Preferably, post clip 350 is secured to post 60 by screws 386 as illustrated, but other means of attachment may be used.

In the preferred embodiment shown by FIGS. 15 through 20, the post clip 350 includes essentially all of the parts of post clip 250 of the first embodiment. However, in the preferred embodiment, post clip 350 includes safety latch 300.

Safety latch 300 includes handle 310 and hook 320 which are joined to extension 315 which is pivotally attached to C-shaped housing 360 at opening 322. Fastening means 323 holds the extension 315 in opening 322 of C-shaped housing 350. Within C-shaped housing 360, extension 315 preferably includes a cam portion 324 which is positioned between cam spring 326 and wall 328 of C-shaped housing 360.

Safety latch 300 can be opened by pulling handle 310 to the rear causing extension 315 to pivot about opening 322 whereby hook 320 moves away from the opening above slot 362 of C-shaped housing 350. This allows the insertion and removal of lower channel 222 of shell 212 when the back is attached to or removed from the wheelchair. However, when the back is in place, handle 310 may be moved forwardly and extension 315 rotates about opening 322 to position hook 320 above slot 362 of C-shaped housing 350 thus in essence preventing removal of lower channel 222 of shell 212 from opening 362.

In the preferred embodiment shown in FIGS. 15–20 cam spring 330 is mounted in channel 364 and is affixed to wall 332 of C-shaped housing 360 by rivets 376. This embodiment further contemplates the inclusion of cam 324 on extension 315. Cam 324 is positioned between cam spring 330 and wall 374 of C-shaped housing 360. Cam spring 330 is biased toward wall 374. The action cam spring 330 on cam 324 urges hook 320 into the closed position and thus avoids accidental opening of the safety latch. Alternatively, when hook 320 is in its disengaged position, cam 324 and cam spring 326 cooperate to maintain the hook in the non-engaged position.

Figure 14:
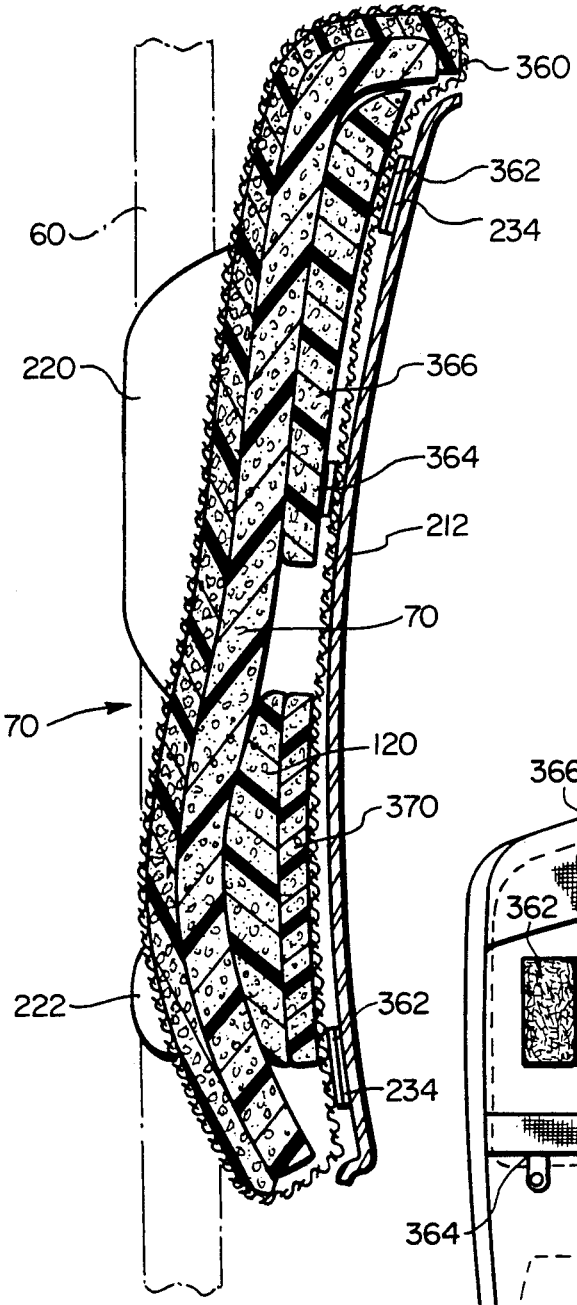
FIG. 14 is a cross-sectional view taken along line 14—14 of FIG. 13 of the further embodiment of a wheelchair back system according to this invention, including the cushion and cover.

The cushion 70 and cover of the alternate embodiment of this invention will now be described in relation to FIGS. 13 and 14.

Figure 13:
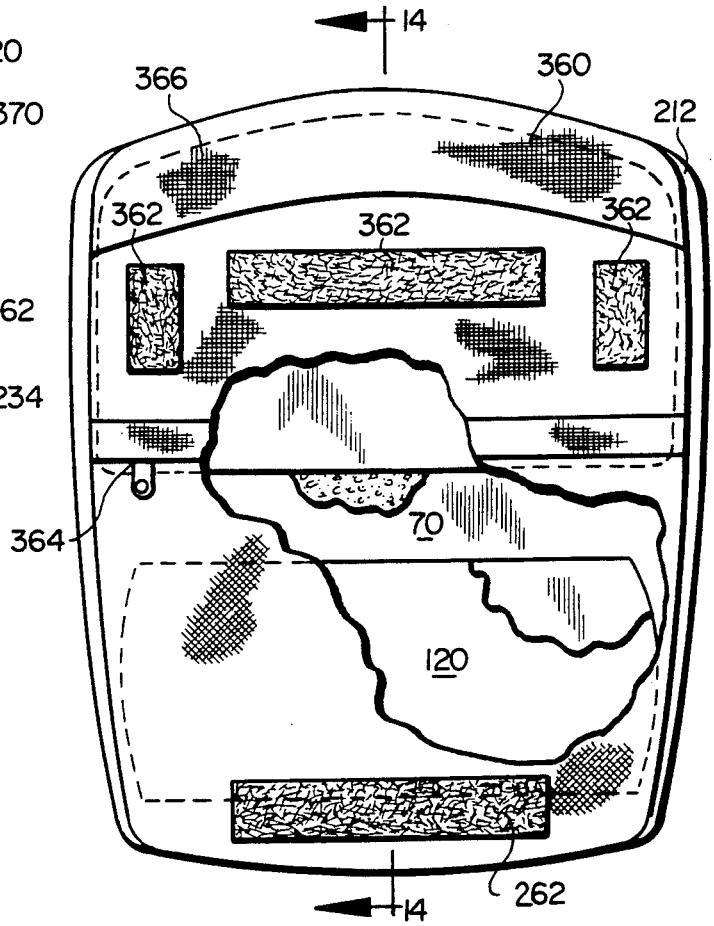
FIG. 13 is a front view of the further embodiment of a wheelchair back system according to this invention, in partial cutaway to show the layering of the movable supports.
Figure 15:
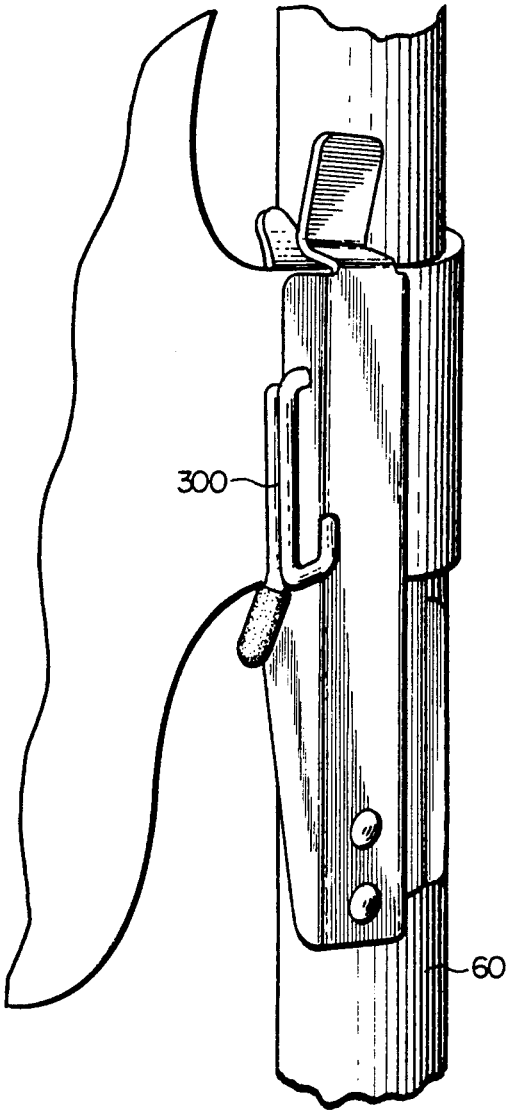
FIG. 15 is an isometric view of another embodiment of the post clip in the unlocked position, mounted on a wheelchair post.
Figure 16:
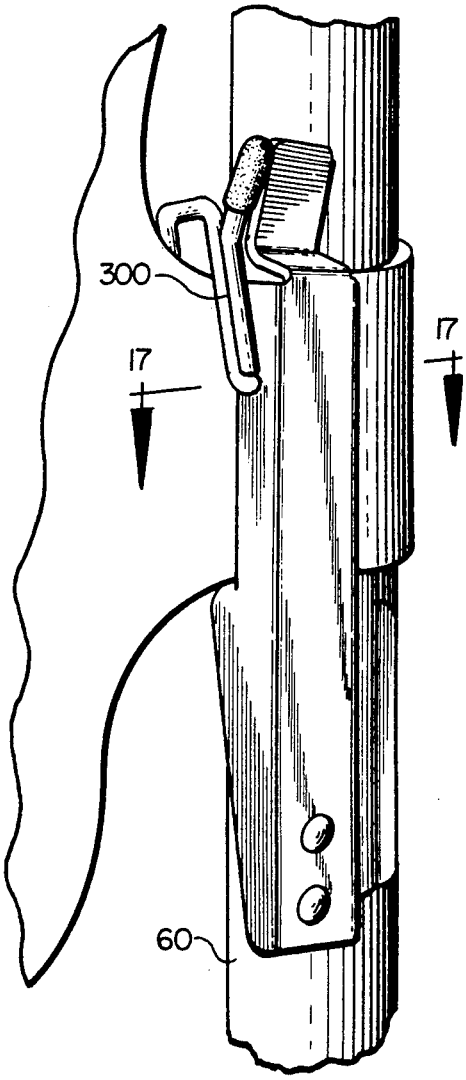
FIG. 16 is an isometric view of the post clip embodiment shown in FIG. 16, in the latched position mounted on a wheelchair post.
Figure 17:
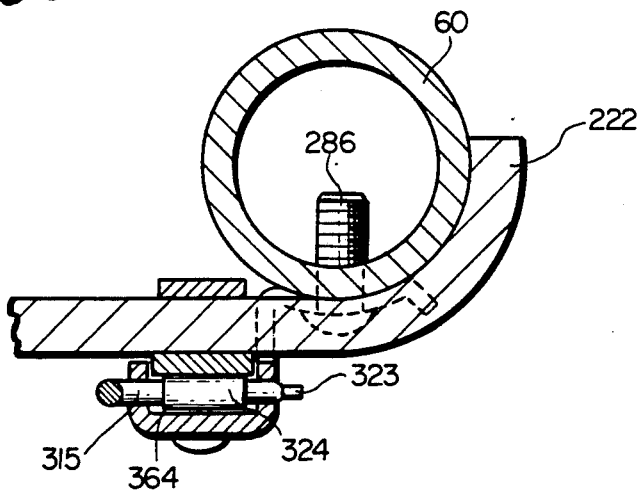
FIG. 17 is a top view of the post clip of FIG. 16 taken in Section 17—17.
Figure 18:
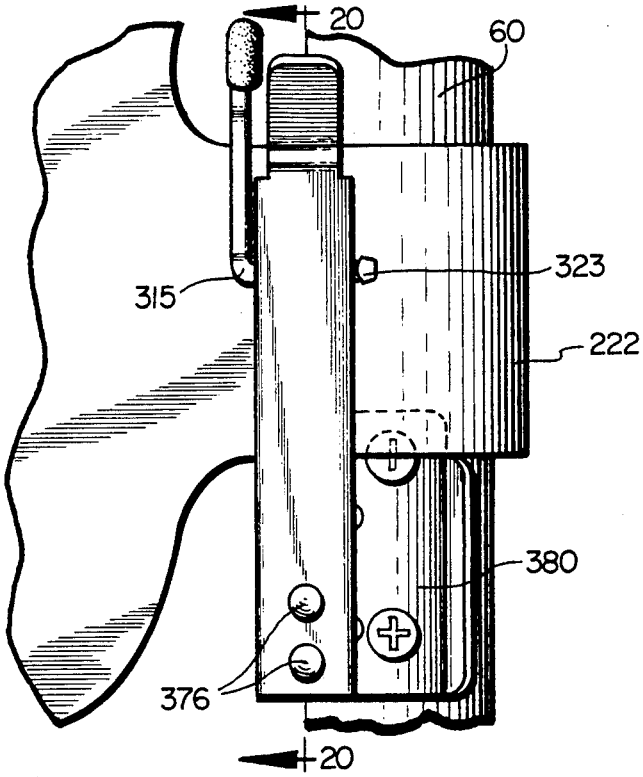
FIG. 18 is a rear view of the post clip of FIG. 16 mounted on a wheelchair post.
Figure 19:
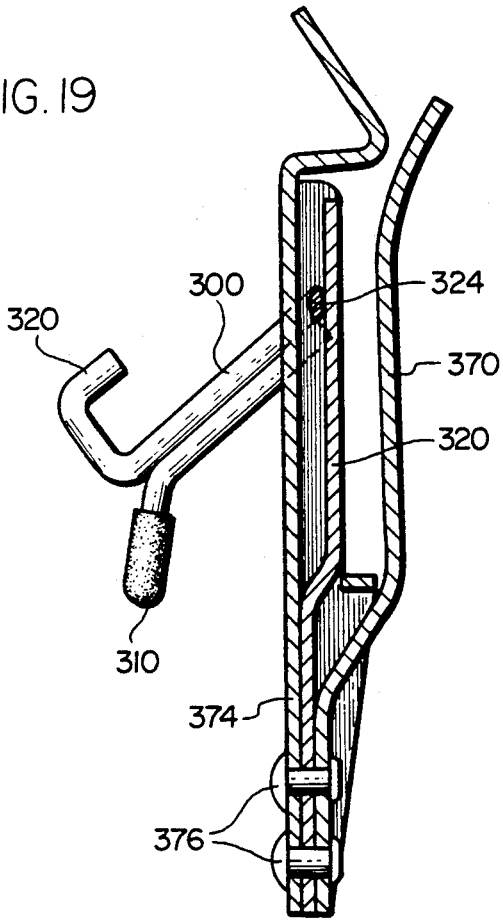
FIG. 19 is a side view of the post clip of FIG. 16 taken in section showing the clip in the unlatched position and FIG. 20 is a side view of the post clip of FIG. 16 taken in section showing the clip in the latched position.
Figure 20:
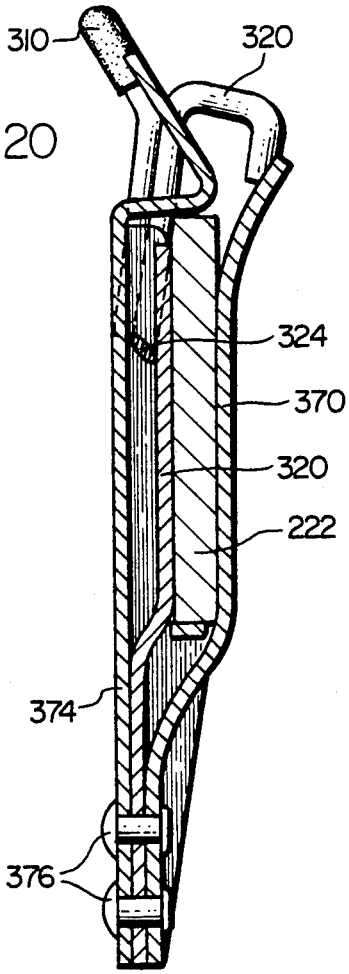

FIG. 13 is a front view of a cushion 70 is shown in partial cutaway to show lumbar support 268. FIG. 14 is a cross-sectional view of FIG. 13 taken along line 14—14. A cover 260 is provided in this further embodiment which is designed to fit over cushion 70 as in the previous embodiment. Cover 260, however, totally encases cushion 70 and any additional supports used therewith. Cover 260 included four strips of VELCRO 262 to engage the four strips of VELCRO 234 on the shell 212. Hence the cushion 70 and any additional supports as will be described below are retained on the shell 212 by VELCRO, which permits easy removal of the cushion 70 for cleaning or rearranging the additional supports. Cover 260 includes a zipper opening 264 for removing the cover 260 from cushion 70.

Cushion

Cushion 70 is preferably fabricated from a open cell polyurethane foam because it is relatively light in weight, although other materials may be used. Cushion 70 preferably extend within the well defined by shell 212 between the C-shaped cutouts 224. The height of the cushion may be approximately the same as the shell 212.

A back wedge 366 (shown in phantom) may optionally be used to adjust the seating position of the user in a more upright or vertical position. Back wedge 366 may be used, for example, when the typical backward bend of vertical posts 60 causes the seat back system to be reclined too severely. The back wedge 266 may generally comprise open cell polyurethane foams as in the cushion. This material provides enough adherence in so that the back wedge 366 may be held in place without additional adhesives. To insert back wedge 366, the zipper opening 364 in the cover 360 is opened and back wedge 366 is inserted with the thicker end upwards, as shown in FIG. 14. If a more upright position is required a polyurethane foam shim may be inserted (not shown).

Additionally, a lumbar support 120 is optionally provided for a straight sitting position and to reduce back pain. The lumbar support 120 may also comprise open cell polyurethane foam which adheres to like material. The lumbar support 120 is inserted between the cushion 70 and the cover 140. Additionally shim 370 comprising open cell polyurethane foam may be used to increase the thickness of the lumbar support.

The scope of the invention herein shown and described is to be considered only as illustrative. It will be apparent to those skilled in the art that numerous modifications may be made therein without departure from the spirit of the invention and the scope of the appended claims.

I claim:

1. A wheelchair back system removably affixable to vertical wheelchair posts, said wheelchair back system comprising:

a shell and a pair of post clips;

said shell having an upper channel and a lower channel on each side, said upper channels being vertically aligned with the lower channels on the corresponding side, one of said channels on each side being open to the rear and the other of said channels on each side being open to the front, whereby said channels are adapted to engage vertical wheelchair posts;

said post clips being affixed to the rear side of vertical wheelchair posts, said clips adapted to releasably engage said front opening channels and to secure said channel in engagement with said wheelchair post.

2. The wheelchair back system of claim 1 wherein said upper channel opens to the rear and said lower channel to the front.

3. The wheelchair back system of claim 2 wherein each of said post clips include spring means for biasing said lower channel into engagement by said post clip and releasing said lower channel when said shell is rotated forwardly.

4. The wheelchair back system of claim 2 wherein said post clip includes a spring and a relatively rigid C-shaped housing, said C-shaped housing configured to engage said lower channel of said shell, said spring being positioned to urge said lower channel into said C-shaped housing, but to release said lower channel from said lower C-shaped housing when said shell rotated forwardly.

5. The wheelchair back system as claimed in claim 2 wherein said channels include an outer side and an inner side, and said shell is wider than vertical wheelchair posts, said shell being configured so that it may flex when pressure is applied, said shell flexing to the point that said outer side of said channel contacts vertical wheelchair posts.

6. The wheelchair back system as claimed in claim 2 wherein said shell included a top edge and a bottom edge, said top edge being curved backwardly and arched convexly so that a user may arch his back over said shell.

7. The wheelchair back system of claim 1 wherein said post clips include a safety latch adapted to hold said channels in engagement with said post clips.

8. The wheelchair back system of claim 7 wherein said safety latch includes a spring which alternately biases said safety latch into the closed position.

9. The wheelchair back system of claim 7 wherein the safety latch includes a spring which biases said safety latch in the closed position when closed and in the open position when open.

* * * * *